United States Patent [19]

Furukawa

[11] Patent Number: 5,013,027

[45] Date of Patent: May 7, 1991

[54] SHEET SORTER

[75] Inventor: Hideaki Furukawa, Yokohama, Japan

[73] Assignee: Canon Kabushiki Kaisha, Tokyo, Japan

[21] Appl. No.: 561,376

[22] Filed: Aug. 1, 1990

Related U.S. Application Data

[63] Continuation of Ser. No. 418,827, Oct. 4, 1989, abandoned, which is a continuation of Ser. No. 170,666, Mar. 10, 1988, abandoned, which is a continuation of Ser. No. 770,084, Aug. 28, 1985, abandoned.

[30] Foreign Application Priority Data

Sep. 5, 1984 [JP] Japan ..... 59-185998

[51] Int. Cl.[5] ..... B65H 39/10

[52] U.S. Cl. ..... 271/290; 271/294; 271/298

[58] Field of Search ..... 271/288-290, 271/294, 298, 292, 293, 259, 300, 306

[56] References Cited

U.S. PATENT DOCUMENTS

| | | | |
|---|---|---|---|
| 3,905,594 | 9/1975 | Davis | 271/290 |
| 4,026,543 | 5/1977 | Leclere | 271/259 |
| 4,145,037 | 3/1979 | Mol | 271/288 |
| 4,297,069 | 10/1981 | Worthington | 414/462 |
| 4,328,963 | 5/1982 | DuBois et al. | 271/288 |
| 4,400,129 | 8/1983 | Eisenberg et al. | 224/42.03 B X |
| 4,494,748 | 11/1985 | Miyashita et al. | 271/298 |
| 4,671,729 | 6/1987 | McFarland | 414/462 |
| 4,695,218 | 9/1987 | Boyer | 414/462 |
| 4,705,448 | 11/1987 | Mungons | 414/462 |
| 4,738,581 | 4/1988 | Kuhlman | 414/462 |
| 4,741,660 | 5/1988 | Kent | 414/462 |
| 4,775,282 | 10/1988 | Van Vliet | 414/462 |
| 4,797,042 | 1/1989 | McFarland | 414/462 X |

*Primary Examiner*—H. Grant Skaggs

*Attorney, Agent, or Firm*—Fitzpatrick, Cella, Harper & Scinto

[57] ABSTRACT

There is disclosed a sheet sorter with plural sorting bins, in which a selected bin is automatically switched, when sheets of a predetermined number which varies according to the sheet size, are stored therein, to another bin in order to prevent breakage of bins and to ensure smooth bin movement.

16 Claims, 16 Drawing Sheets

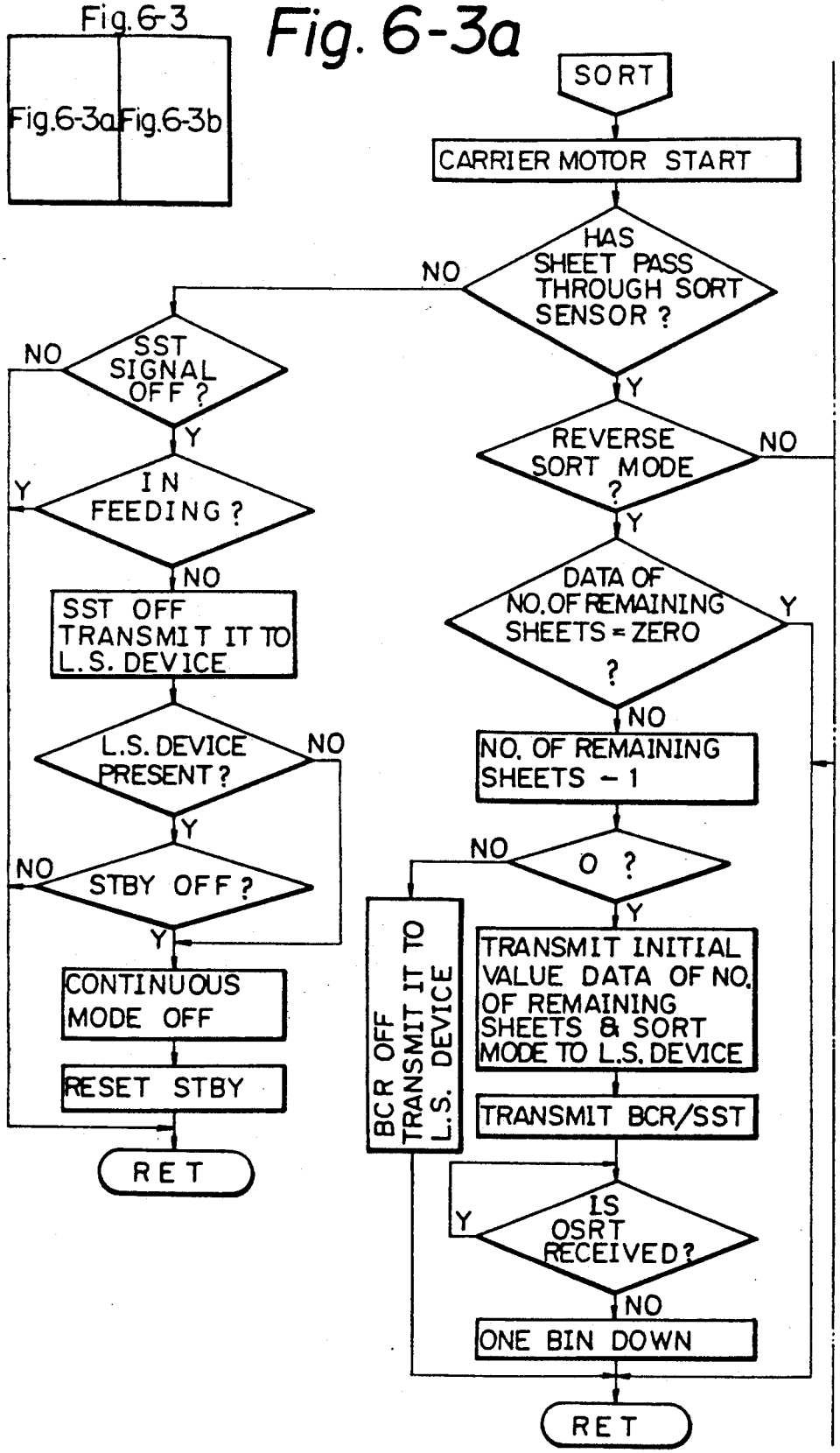
Fig. 6-3
Fig.6-3a
Fig.6-3b
Fig. 6-3a
SORT
CARRIER MOTOR START
HAS SHEET PASS THROUGH SORT SENSOR ?
NO
Y
REVERSE SORT MODE ?
NO
Y
DATA OF NO. OF REMAINING SHEETS = ZERO ?
Y
NO
NO. OF REMAINING SHEETS − 1
O ?
NO
Y
TRANSMIT INITIAL VALUE DATA OF NO. OF REMAINING SHEETS & SORT MODE TO L.S. DEVICE
TRANSMIT BCR/SST
IS OSRT RECEIVED?
Y
NO
ONE BIN DOWN
RET
BCR OFF TRANSMIT IT TO L.S. DEVICE
SST SIGNAL OFF ?
NO
Y
IN FEEDING ?
Y
NO
SST OFF TRANSMIT IT TO L.S. DEVICE
L.S. DEVICE PRESENT ?
NO
Y
STBY OFF ?
NO
Y
CONTINUOUS MODE OFF
RESET STBY
RET

SHEET SORTER

This application is a continuation of application Ser. No. 418,827 filed Oct. 4, 1989, now abandoned, which is a continuation of application Ser. No. 170,666 filed Mar. 10, 1988, now abandoned, which is a continuation of parent application Ser. No. 770,084 filed Aug. 28, 1985, also abandoned.

BACKGROUND OF THE INVENTION

1. Field of the Invention

The present invention relates to a sheet sorter provided with plural storage bin means into which sorted sheets are and supplied thereto.

2. Description of the Prior Art

There is known an apparatus provided with plural bins wherein sheets discharged from a recording apparatus such as a copier are sorted in the plural bins. Such an apparatus is referred to as a sorter hereinafter.

Among such sorters there is known an apparatus capable of operating in a mode in which sheets are stored in a bin and are then switched to another bin when a predetermined number of sheets are stored.

However such an apparatus is subjected to failures such as breakage of bins due to excessive weight of large-sized sheets, since the apparatus has to handle sheets of various sizes which have different weights.

Also in a sorter in which sheet storage into plural bins is achieved by the movement thereof, the increasing weight of sheets on the bin may hinder smooth bin movement, eventually disturbing exact sheet storage.

Besides such an apparatus cannot be connected in plural stages, and is therefore unable to sort a large amount of sheets.

Furthermore, such an apparatus performs sheet sorting only in one direction, so that the bins have to be moved to bring the first bin to the sheet storing position each time a single job, for example copy preparation from an original document, is completed, thus requiring a long time for sheet sorting.

Furthermore, in such an apparatus, even after the last one of a series of sheets discharged in a single job, for example copy preparation from an original document, is stored in a bin, the bins are moved in the sorting direction, thus requiring an unnecessary bin movement before shifting to a succeeding job.

SUMMARY OF THE INVENTION

In consideration of the foregoing, an object of the present invention is to provide an improved sheet sorter.

Another object of the present invention is to provide a sheet sorter capable of preventing breakage of the storage means and achieving exact sheet sorting.

Still another object of the present invention is to provide a sheet sorter, with movable storage bins for sheet sorting, which can be connected in plural stages to exactly sort a large amount of sheets.

Still another object of the present invention is to provide a sheet sorter capable of reducing the time required for sheet sorting.

The foregoing and still other objects of the present invention will become fully apparent from the following description.

BRIEF DESCRIPTION OF THE DRAWINGS

FIG. 6–1 is a main flow chart;

FIGS. 6–2 and 6–3 are flow charts showing control programs for executing the sorting and reverse sorting modes; and FIGS. 7–1 and 7–2 are flow charts showing a control program for executing collating mode.

DETAILED DESCRIPTION OF THE PREFERRED EMBODIMENTS

Now the present invention will be clarified in detail by embodiments thereof shown in the attached drawings.

Figure 1:
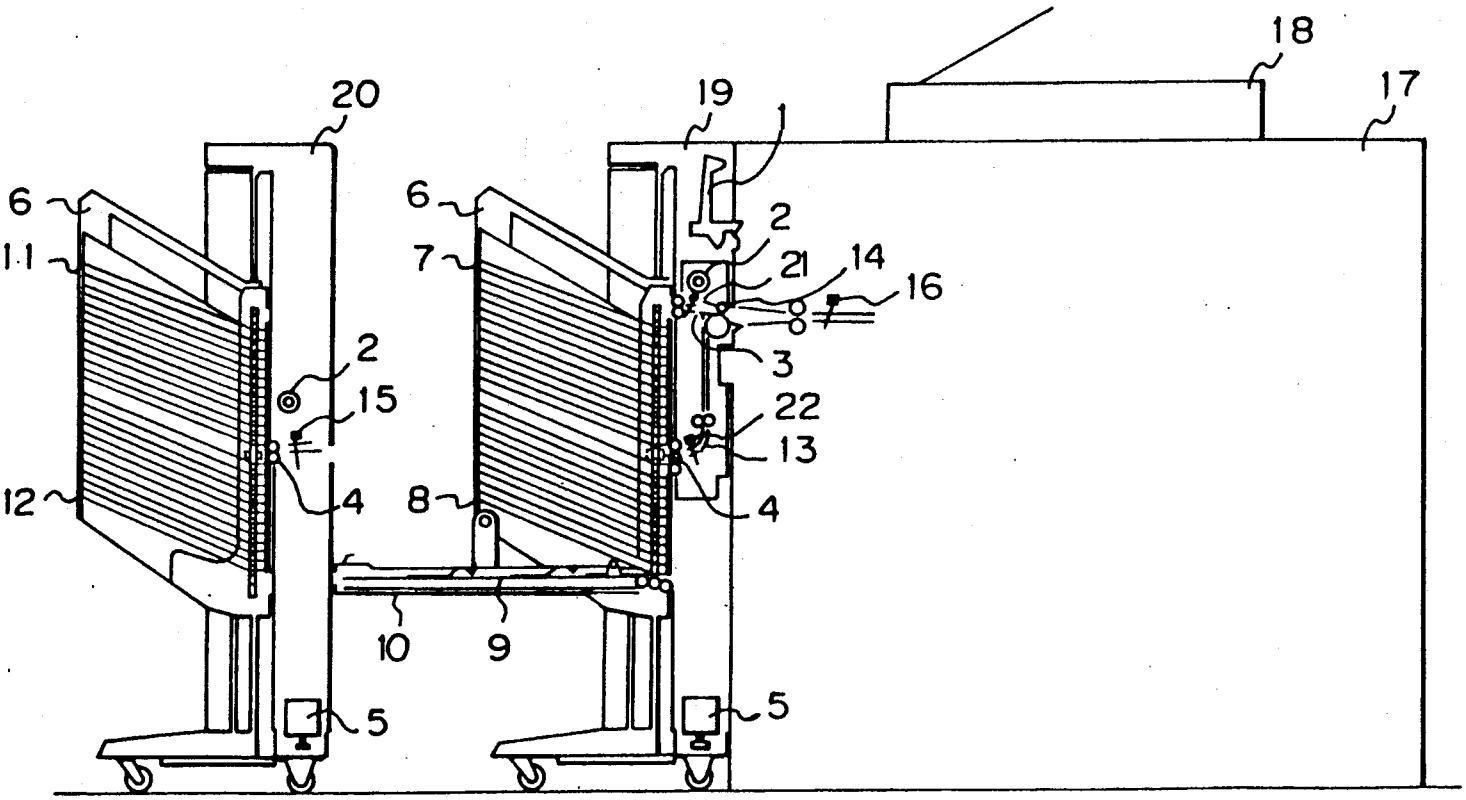
FIG. 1 is a schematic view showing a connection between a copying apparatus with an automatic original feeder and a sorter.

Referring to FIG. 1, a copying apparatus 17 is provided with an automatic original feeder 18 and is connected at the discharge side thereof, to sorters 19, 20 with movable bins, each of which is provided with 25 sheet sorting bins.

Said sorter with movable bins is capable of: a tray mode in which the sheets discharged from the copying apparatus 17 are stored in a bin 7; a group tray mode in which the sheets discharged from the copying apparatus 17 are stored in groups of a determined number, which is 50 sheets for A4 or smaller size, or 25 sheets for larger sizes; a collating mode in which sheets of a single job, for example sheet copied from a same original document, are stored in a bin and the bins are shifted when the original document is changed; a sorting mode in which sheets of a single job are respectively stored in different bins; and a reverse sorting mode in which sheets are stored in the sorting mode but in the reverse order.

The copying apparatus 17 and the sorters 19, 20 exchange various data by serial communication. As an example, in case of communication between the copying apparatus 17 and the sorter 19, the copying apparatus 17 at first releases a request signal REQ, in response to which the sorter 19 returns an acknowledge signal ACK, and the copying apparatus 17 then transmits data by a signal TXD.

In response to said data, the sorter 19 transmits data by a signal RXD to the copying apparatus 17. Similar data communication is conducted also between the sorters 19, 20. Tabs. 1 and 2 summarize the data transmitted by said communication.

TABLE 1

| | | Communication data (1) |
|---|---|---|
| | | Copying apparatus to Sorter 19<br>Sorter 19 to Sorter 20 |
| (1) | SST | Sorter operation signal |
| (2) | HON | Sheet discharge signal from sheet discharging side |
| (3) | BCR | Sorter home position signal |
| (4) | BSFT | Sorter bin shift signal |
| (5) | REQ | Signal requesting number of sheets in sorter |
| (6) | Operation mode | Sorting mode |

TABLE 1-continued

| | Communication data (1) |
|---|---|
| | Copying apparatus to Sorter 19<br>Sorter 19 to Sorter 20 |
| | Collating mode<br>Tray mode<br>Pre-rotation mode |
| (7) Jam reset signal | |
| (8) Size Sheet size | |
| (9) Number of sheets to be discharged | |
| (10) Internal RAM address data | |

TABLE 2

| | Communication data (2) |
|---|---|
| | Sorter 19 to Copying Apparatus<br>Sorter 20 to Sorter 19 |
| (1) STBY | Sorter stand-by signal |
| (2) SJAM | Sorter jam signal |
| (3) ALARM | Sorter door switch open signal |
| (4) OSRT | Old original sorting signal |
| (5) RSRT | Reverse sorting signal |
| (6) Total bin number data | |
| (7) Data on number of sorted sheets | |
| (8) Internal RAM data | |

There are also employed: a signal S-CNCT indicating that the copying apparatus 17 is connected to the sorter 19; a signal S-ON controlling the power supply to the sorter 19; a signal S2-CNCT indicating that the sorter 19 is connected to the sorter 20; and a signal S1-CNCT controlling the power supply to the sorter 20.

Figure 3:
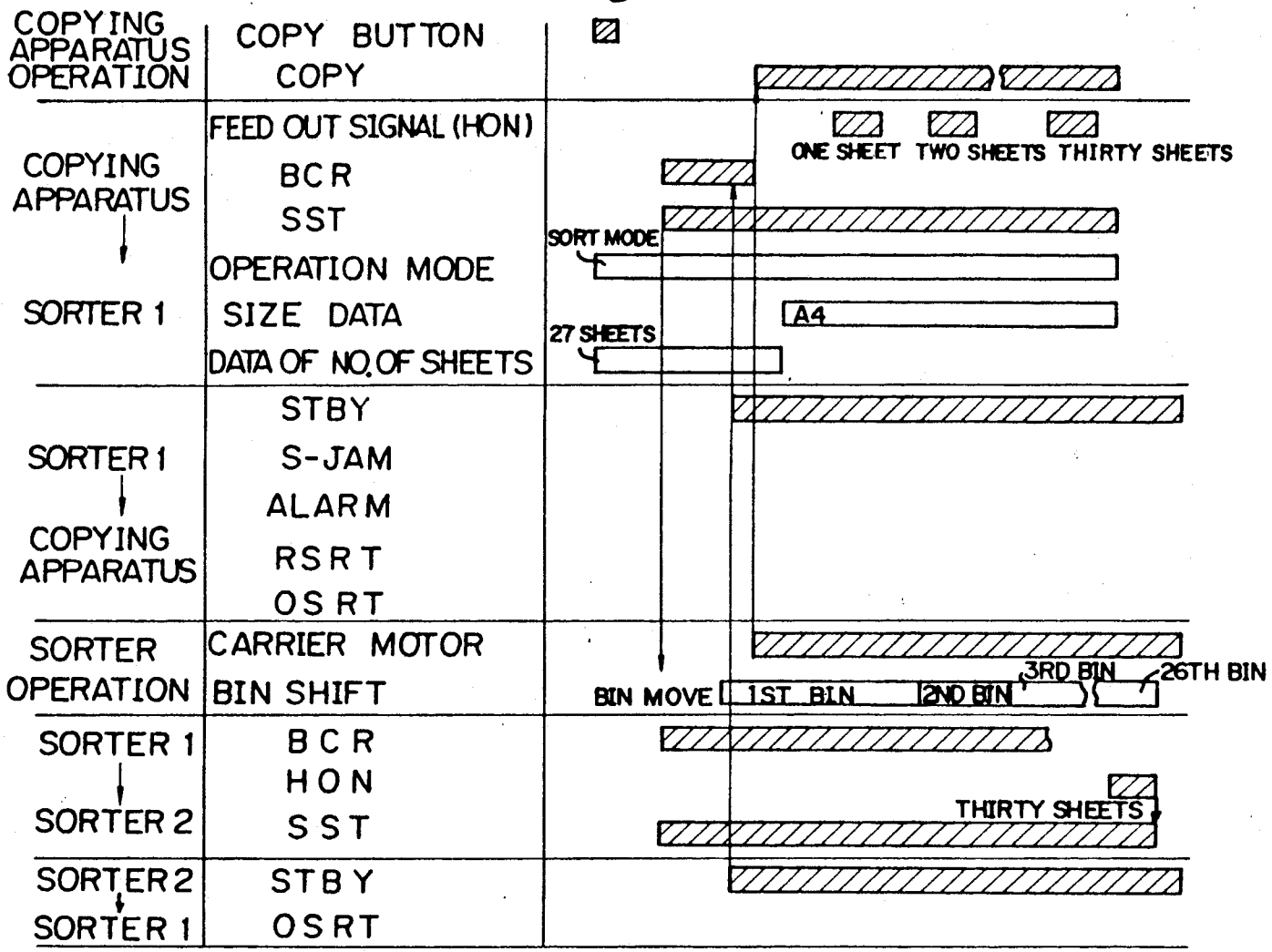
FIGS. 3 and 4 are timing charts showing the timing of function of various parts in the sorting and reverse sorting modes.
Figures 1, 6:
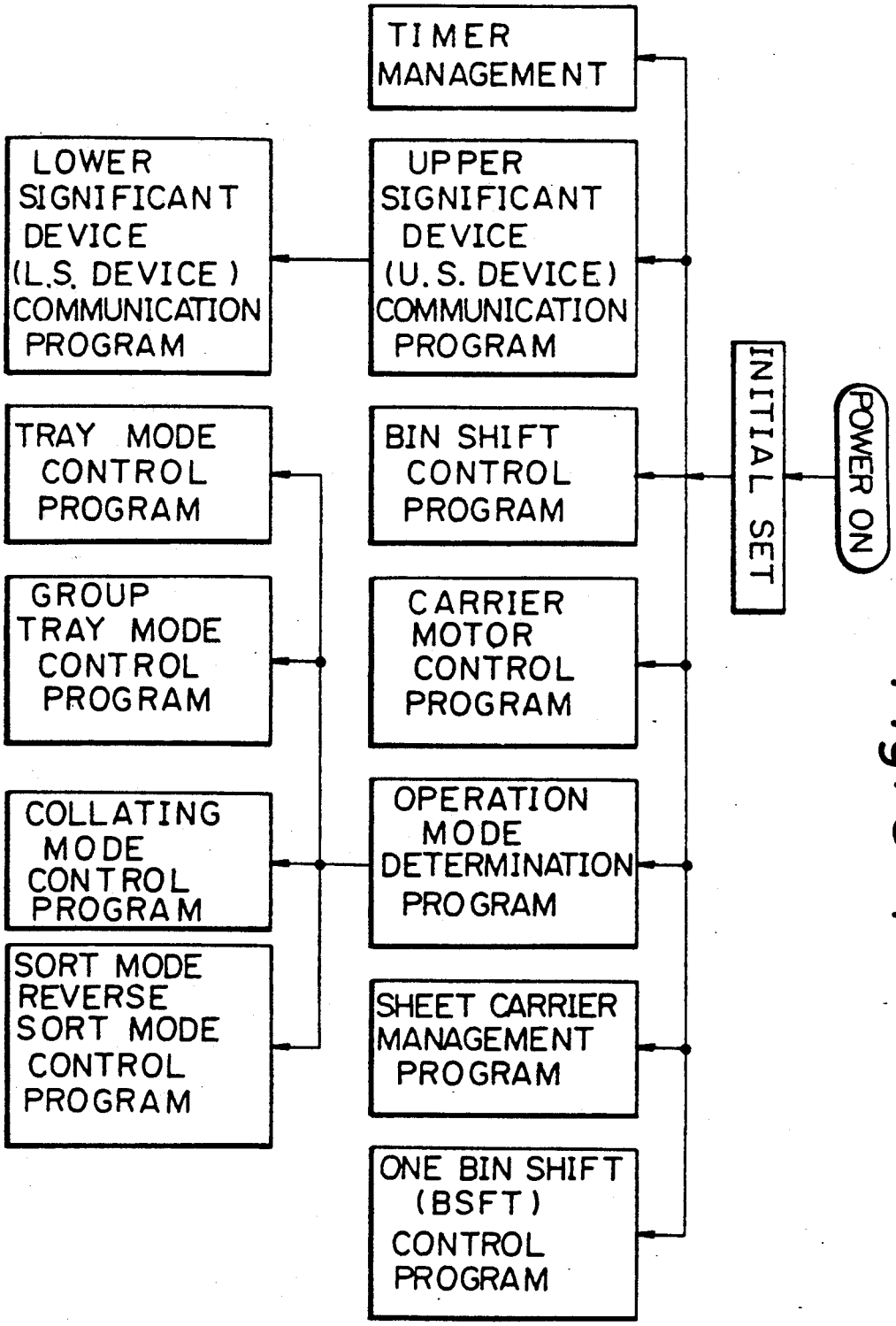
Figures 2A, 6:
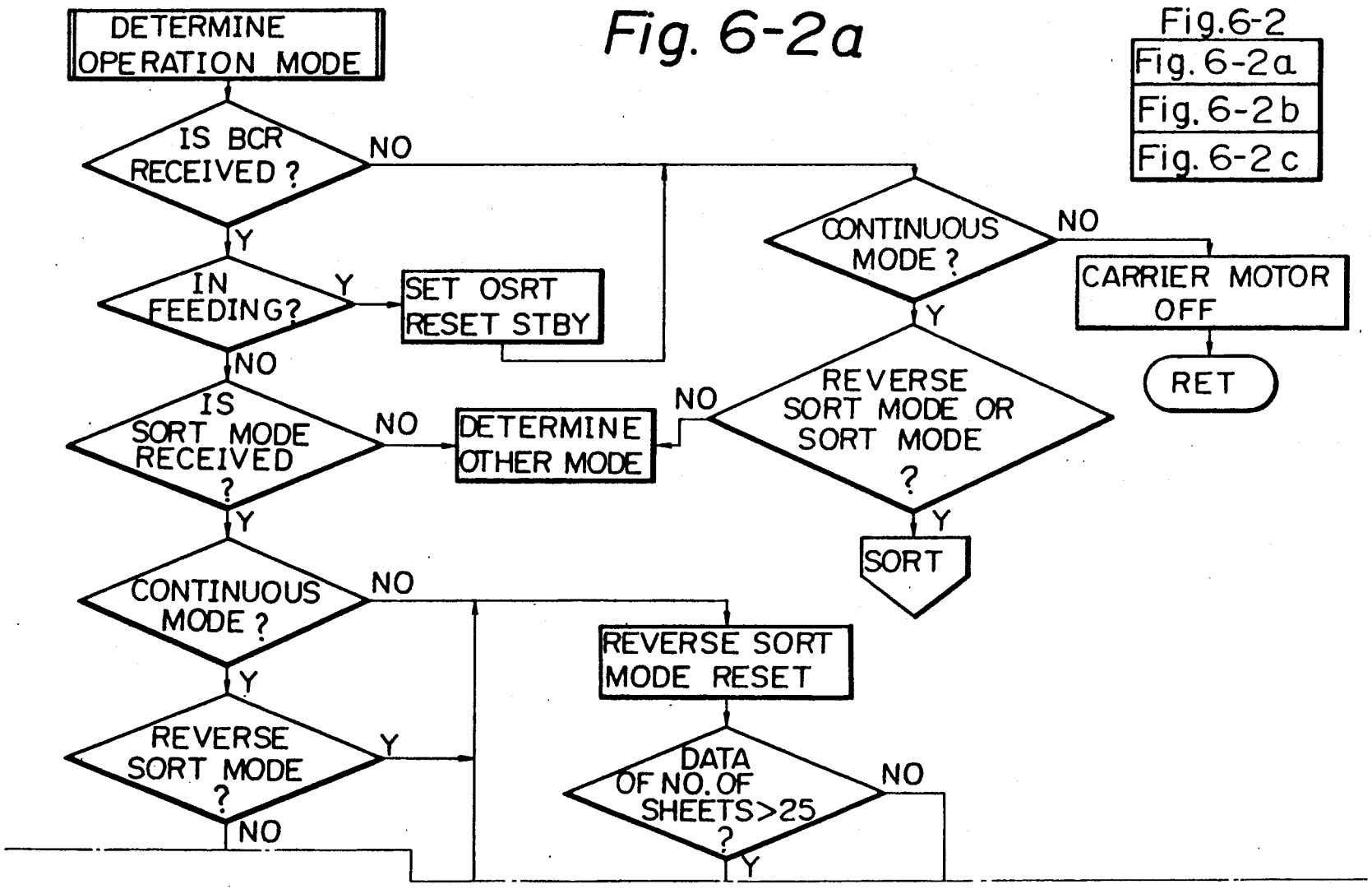
Figures 2B, 6:
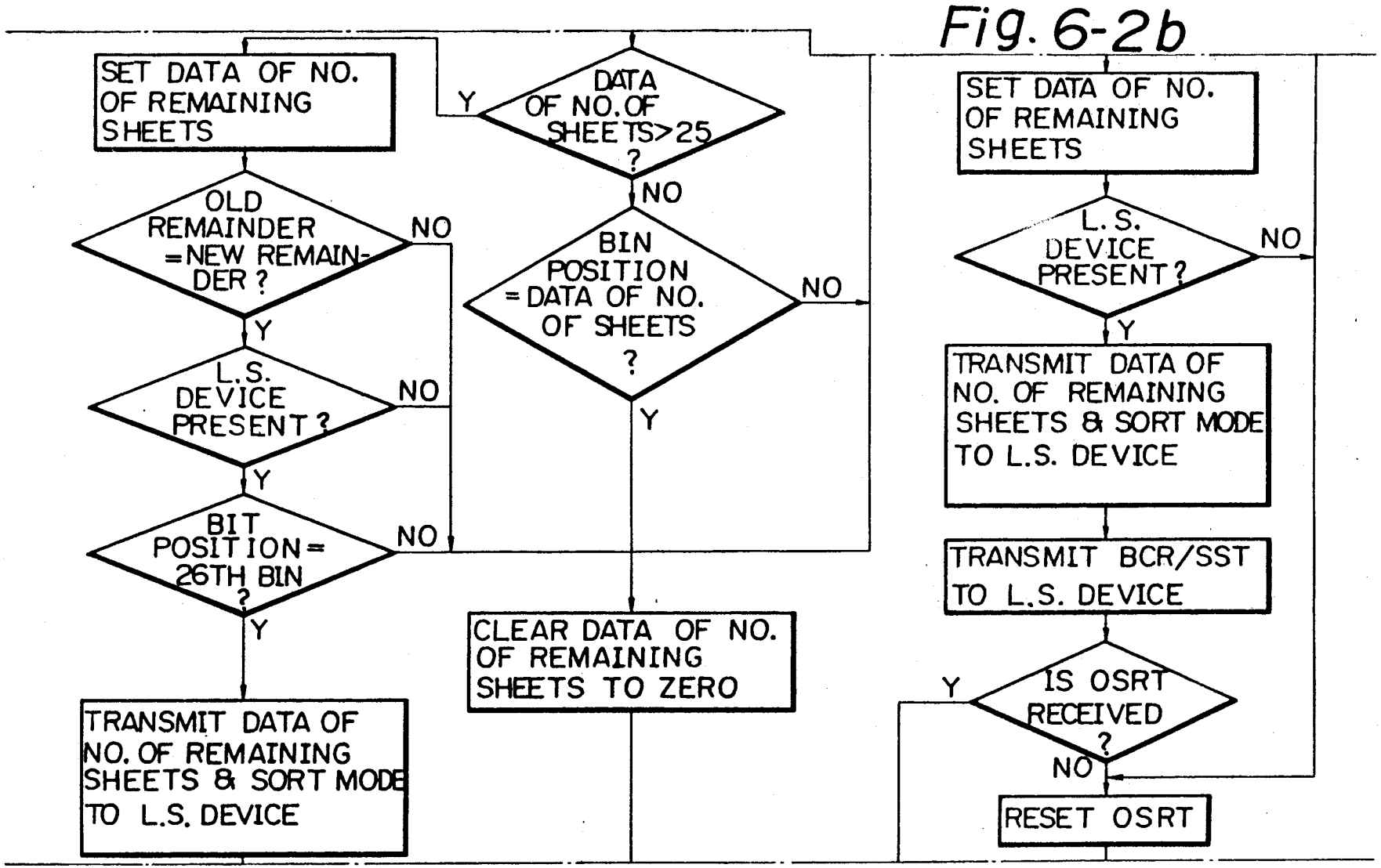
Figures 2C, 6:
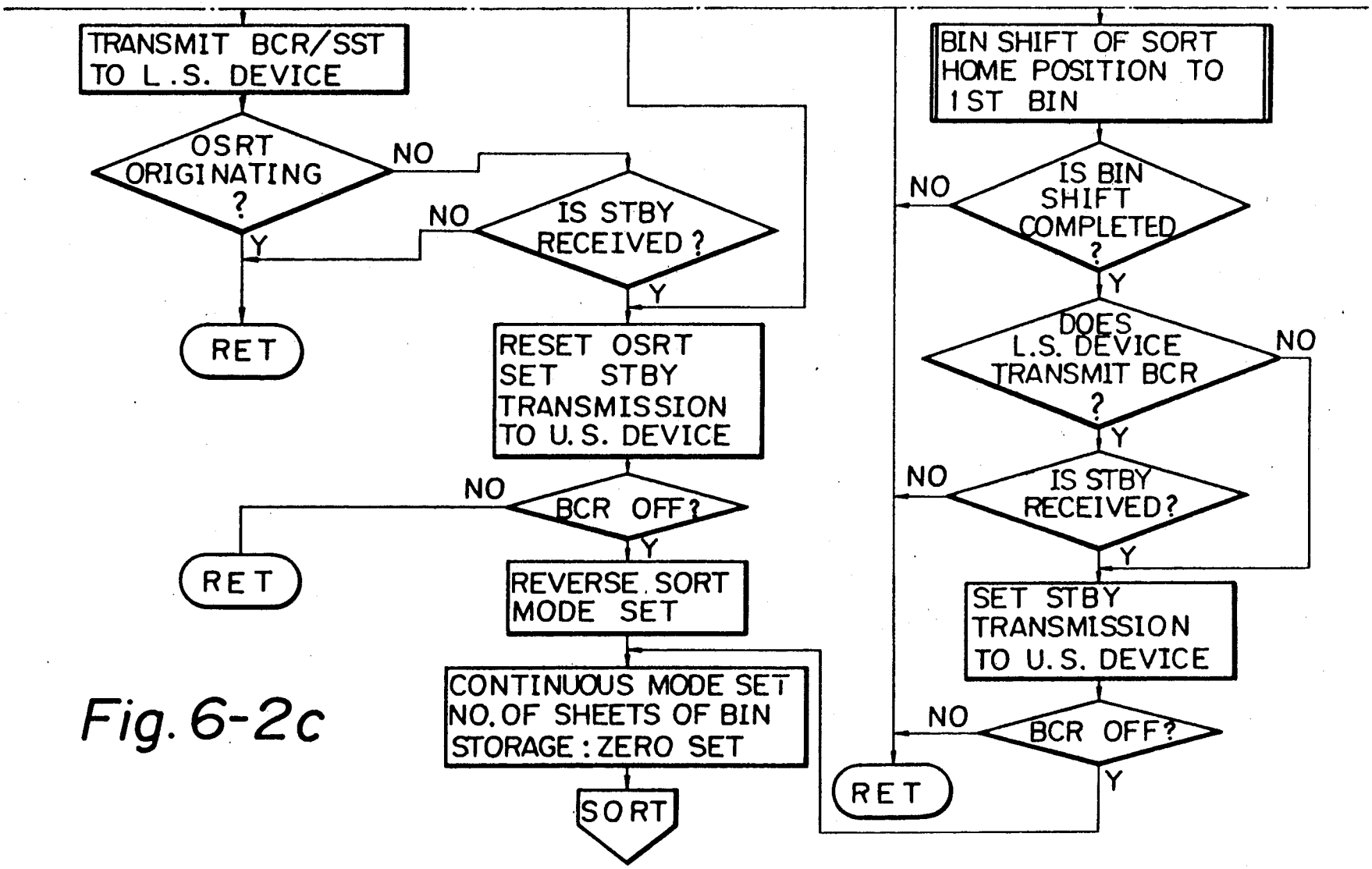
Figures 3B, 6:
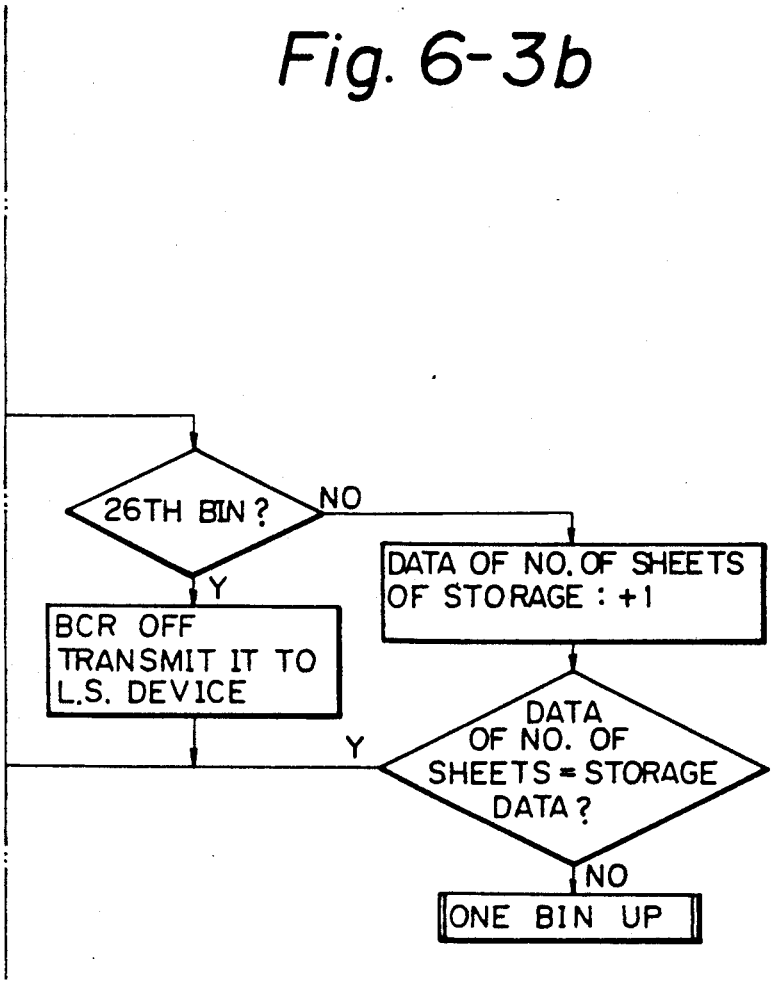

Now reference is made to FIGS. 6-1 to 6-3 for explaining the function in the sorting and reverse sorting modes, in case of making 30 copies from each of two original documents.

Figure 5:
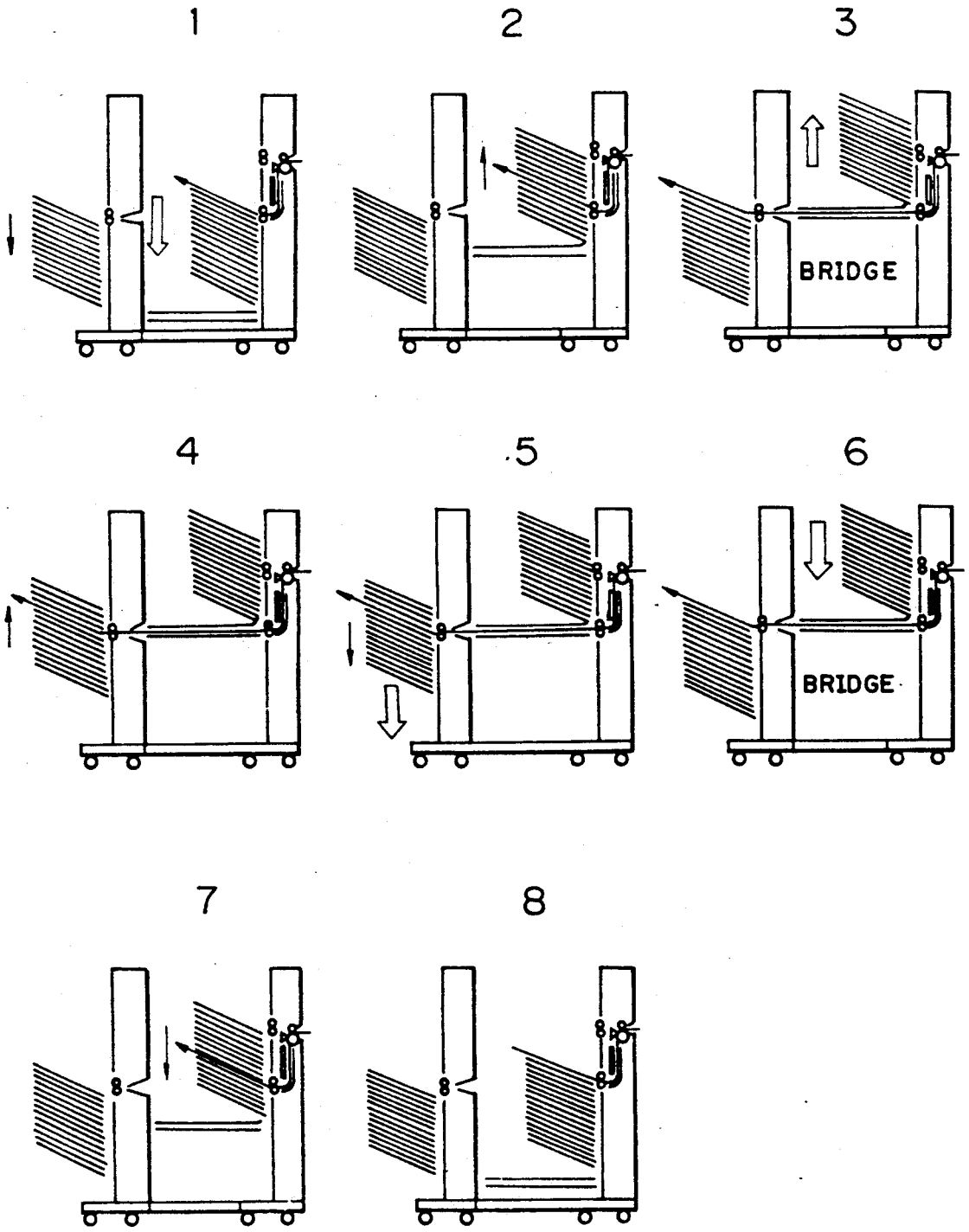
FIG. 5 is a view showing the function of the sorter in the sorting and reverse sorting modes.

When a copy key of the copying apparatus is actuated, data of copy number (30 copies) and selected sorting mode are transmitted from the copying apparatus to the sorter 19 through the communication procedure, and BCR/SST signals are subsequently transmitted. In response to the BCR signal, the sorter 19 provides the sorter 20 with data for 5 copies, indicating the number of copies in excess of 25 copies which can be sorted in the sorter 19, and then the BCR/SST signals (cf. FIG. 3). In response to the BCR signal, the sorters 19, 20 respectively move the bins to a home position in sorting ((1) in FIG. 5). Upon completion of the bin movement, the sorter 20 transmits a STBY signal to the sorter 19. Upon completion of the bin movement in the sorter 19 and upon reception of said STBY signal from the sorter 20, the sorter 19 transmits a STBY signal to the copying apparatus 17 (cf. FIG. 3). In response to said STBY signal from the sorter 19, the copying apparatus turns off the BCR signal and initiates the copying operation, and in response to the turning off of said BCR signal, the sorter 19 activates a conveyor motor 2 thereof. A sheet discharge signal HON is supplied to the sorter 19 while a first sheet passes a sheet discharge sensor 17 of the copying apparatus 17. The sorter 19 starts a jam timer at the moment when said HON signal is terminated for watching the sheet advancement to a sorted sheet sensor 22. Up to the 25th sheet, a bin motor 5 is activated to stepwise move the bins upwards each time a sheet passes said sorted sheet sensor 22. ((2) in FIG. 5).

When 25 sheets have been stored in the sorter 19, it moves the bins to the position of a bridge 10 at the 26th bin and turns off the BCR to the sorter 20 thereby activating the conveyor motor thereof. Thus a 26th sheet from the copying apparatus is transported, through said bridge, to the sorter 20. At the same time, a sheet discharge signal HON is supplied from the sorter 19 to the sorter 20 for detecting sheet jamming therebetween in the same manner as explained before ((3) in FIG. 5).

The sorter 20 elevates the bins stepwise each time a sheet passes a sorted sheet sensor 15, for the sheets from 26th to 29th. When a 30th sheet is transported to the sorter 20, the number of sheets sorted in the sorter 20 becomes equal to the data of 5 sheets previously transmitted from the sorter 19, whereby the stepwise bin elevation is prohibited. Upon completion of the copying operation for the preset number of copies and upon discharge of the last copy sheet from the copying apparatus 17, an automatic original feeder 18 sets a next original document on an exposure position of the copying apparatus 17, and the copying apparatus 17 transmits, to the sorter 19, data of copy number and sorting mode, and then BCR/SST signals in the same manner as explained before. In response the sorter 19 turns off the STBY signal, and transmits an OSPT signal to the copying apparatus 17 until the last copy sheet is stored in the sorter 19 or 20. When the last copy sheet prepared from the last original document passes the sorter 19, it transmits, to the sorter 20, data on the number of copies in excess of sorting capacity of the sorter 19 and sorting mode, and then the BCR/SST signals. In the sorter 19, the data of copy number which is in excess of sorting capacity thereof coincides with the preceding copy number (30 copies), and the 26th bin is placed at the sorting position, and the SST signal is continued. Because of these situations, the sorter 19 is shifted to the reverse sorting mode after the excessive sheets have been transported to the sorter 20.

Until the last copy sheet prepared from the preceding original document is stored, the sorter 20 turns off the STBY signal to the sorter 19 and sends an OSRT signal thereto. When the last copy sheet is stored, the bin position (5th bin) in the sorter 20 coincides with the copy number (5 copies) and with the number of already stored copies (5 copies), and the SST signal is continued. Because of these situations the sorter is shifted to the reverse sorting mode, turns off the OSRT signals and sends STBY and RSRT signals to the sorter 19.

In response to the STBY signal from the sorter 20, and if the reverse sorting mode in the sorter 19 is already established, it transmits STBY and RSRT signals to the copying apparatus 17. Thus the copying apparatus 17 initiates the copying operation on copy sheets supplied for example from a cassette, and the sorting is started from the sorter 20. After a first sheet has been stored in the sorter 20, the bins thereof start stepwise descent, in a direction opposite to the moving direction in the sorting mode ((5) in FIG. 5). When the copies of excess (5 copies) are prepared in the copier 17, and in the presence of the OSRT signal from the sorter 19, the copier 17 temporarily interrupts the copying operation for a determined period, which is at least equal to the sum of a time required by a sheet for storage in the sorter 20 through the bridge 10, and a time required by the bins of the sorter 19 for movement from the 26th bin position to the 25th bin position, thereby completely advancing the 5th sheet to the sorter 19. After sending the 5th sheet to the bridge 10, the sorter 19 sends pseudo BCR/SST signals to the sorter 20.

Figure 4:
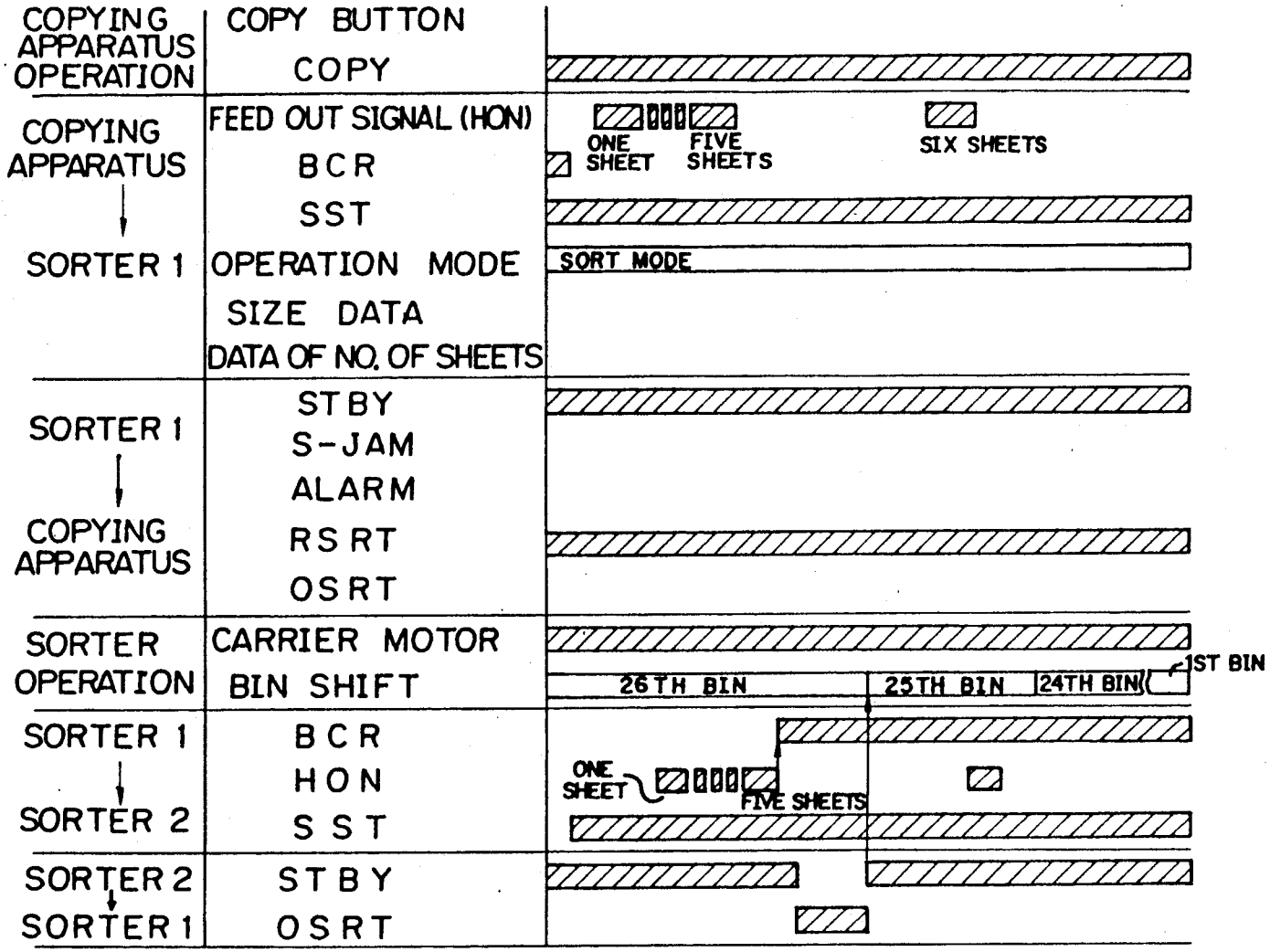

In response to said BCR signal, the sorter 20 turns on the OSRT signal and turns off the STBY signal until the sheet on the bridge is sorted (cf. FIG. 4). Also in response to the BCR signal, the sorter 20 switches the operation from the reverse sorting mode to the sorting mode, and resets the OSRT signal and sends the STBY signal to the sorter 19 when the 5th sheet is stored in the 1st bin at the home position in the sorting mode. The conveyor motor of the sorter 20 is stopped until the BCR signal is turned off. After sending said pseudo BCR/SST signals, the sorter prohibits the bin movement until the OSRT signal from the sorter 20 is turned off. When said OSRT signal is turned off, the sorter 19 moves the bins to the 25th bin position and executes sorting operation for the 26th to 30th sheets by stepwise lowering the bins for each sheet stored in the sorter 19 ((7) in FIG. 5).

A continuous mode means a state, in the use of an automatic original feeder, where at least an original remains to be fed after another original is fed.

Figure 2:
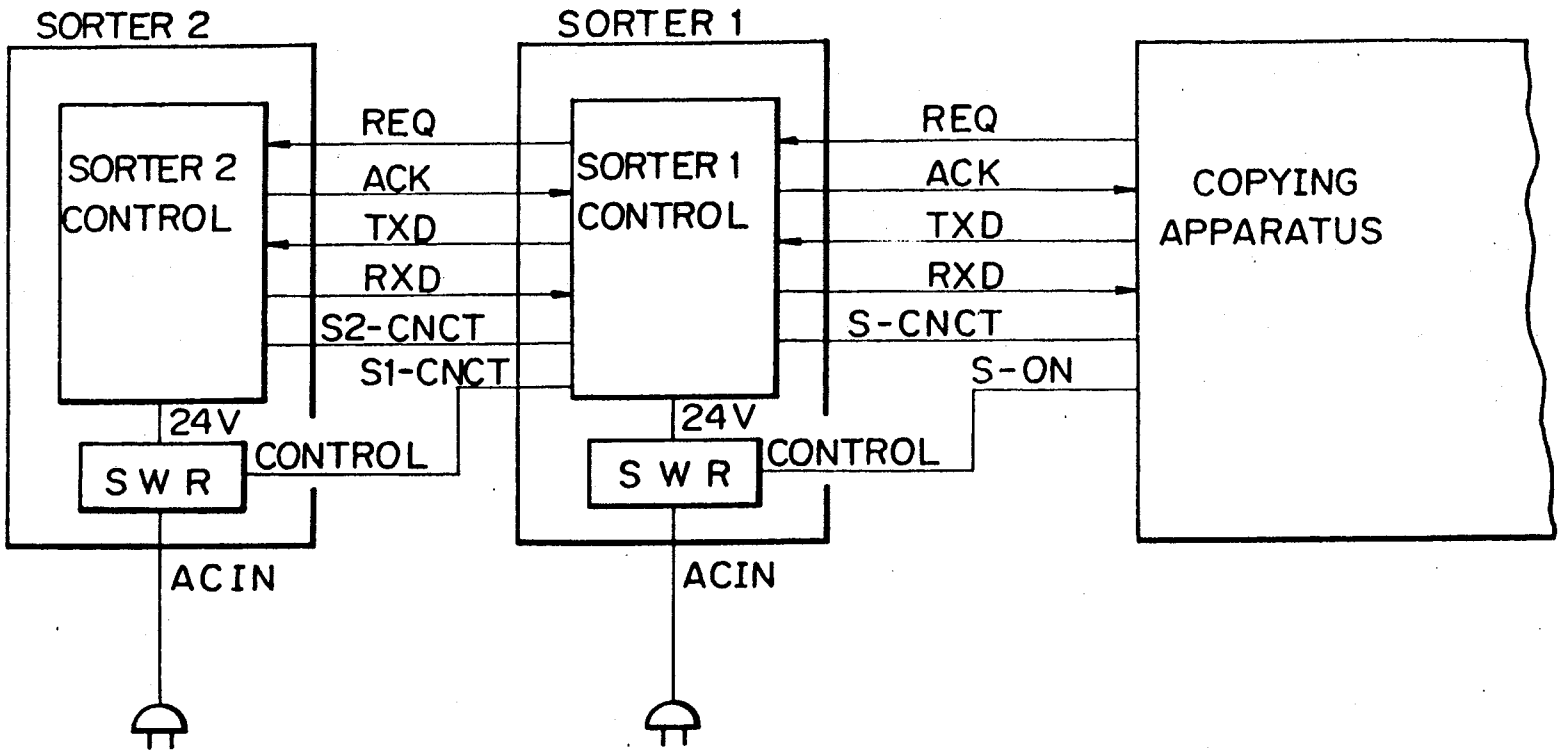
FIG. 2 is a block diagram showing a control unit of the sorter.
Figures 1A, 7:
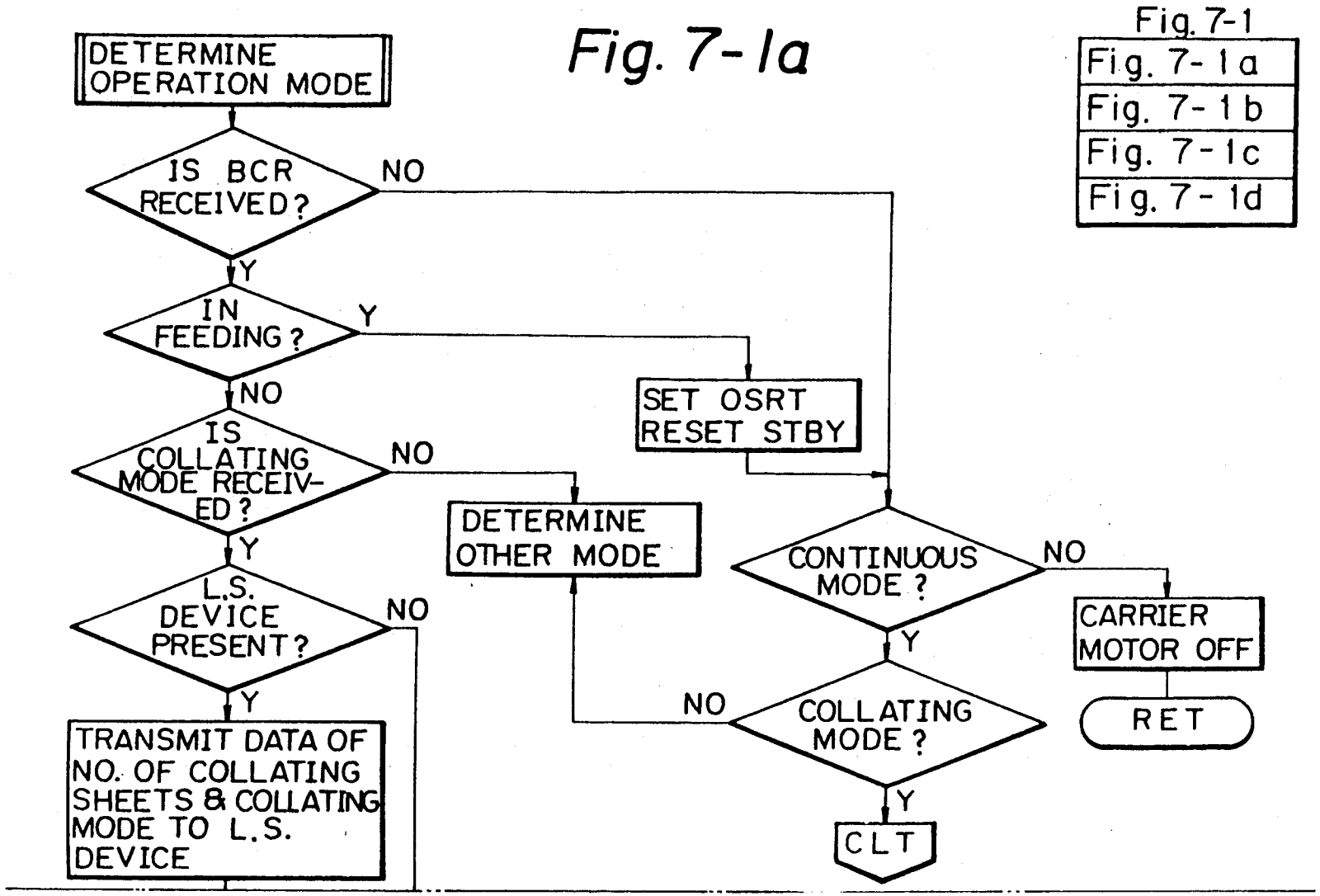
Figures 1B, 7:
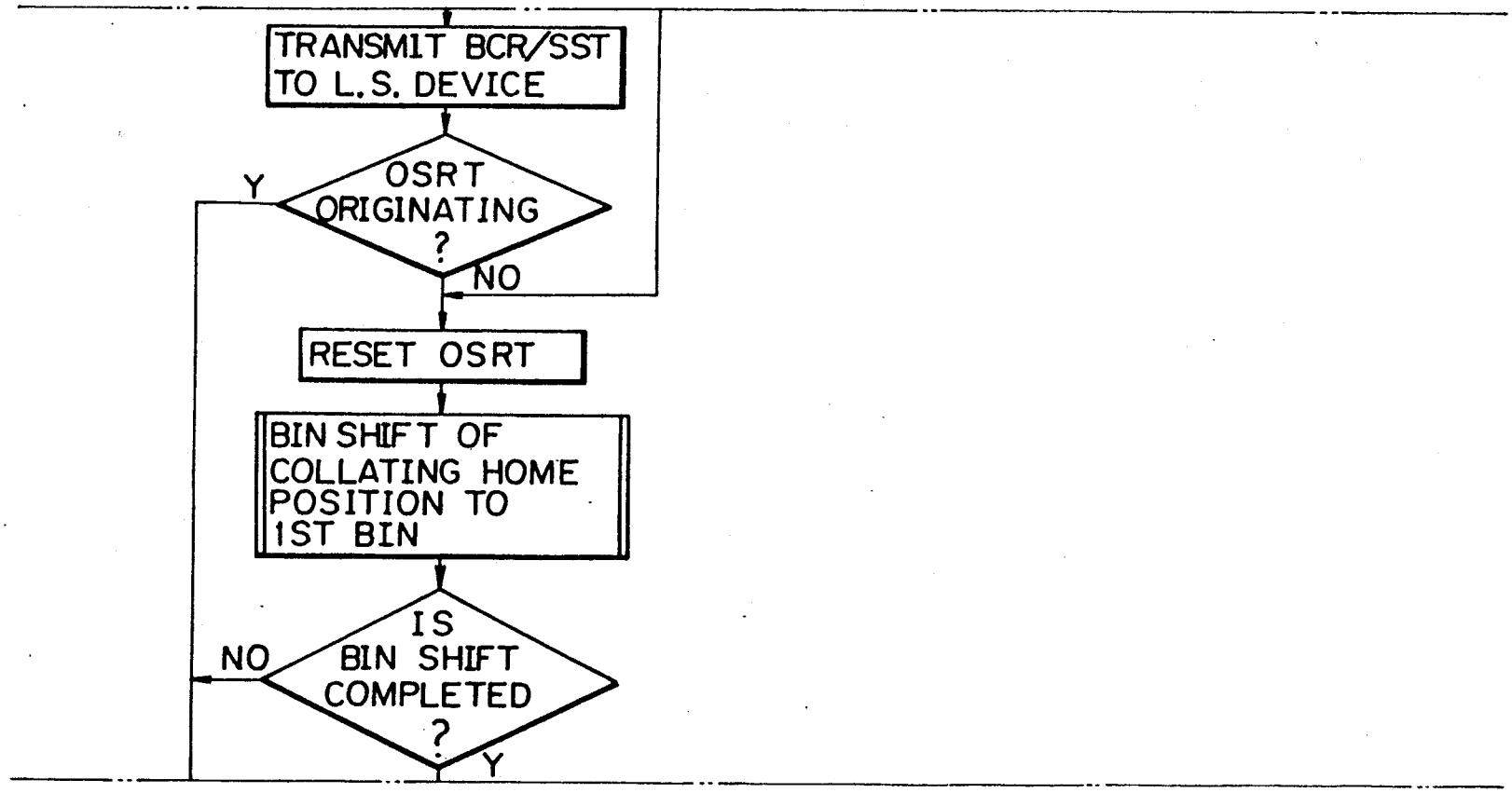
Figures 1C, 7:
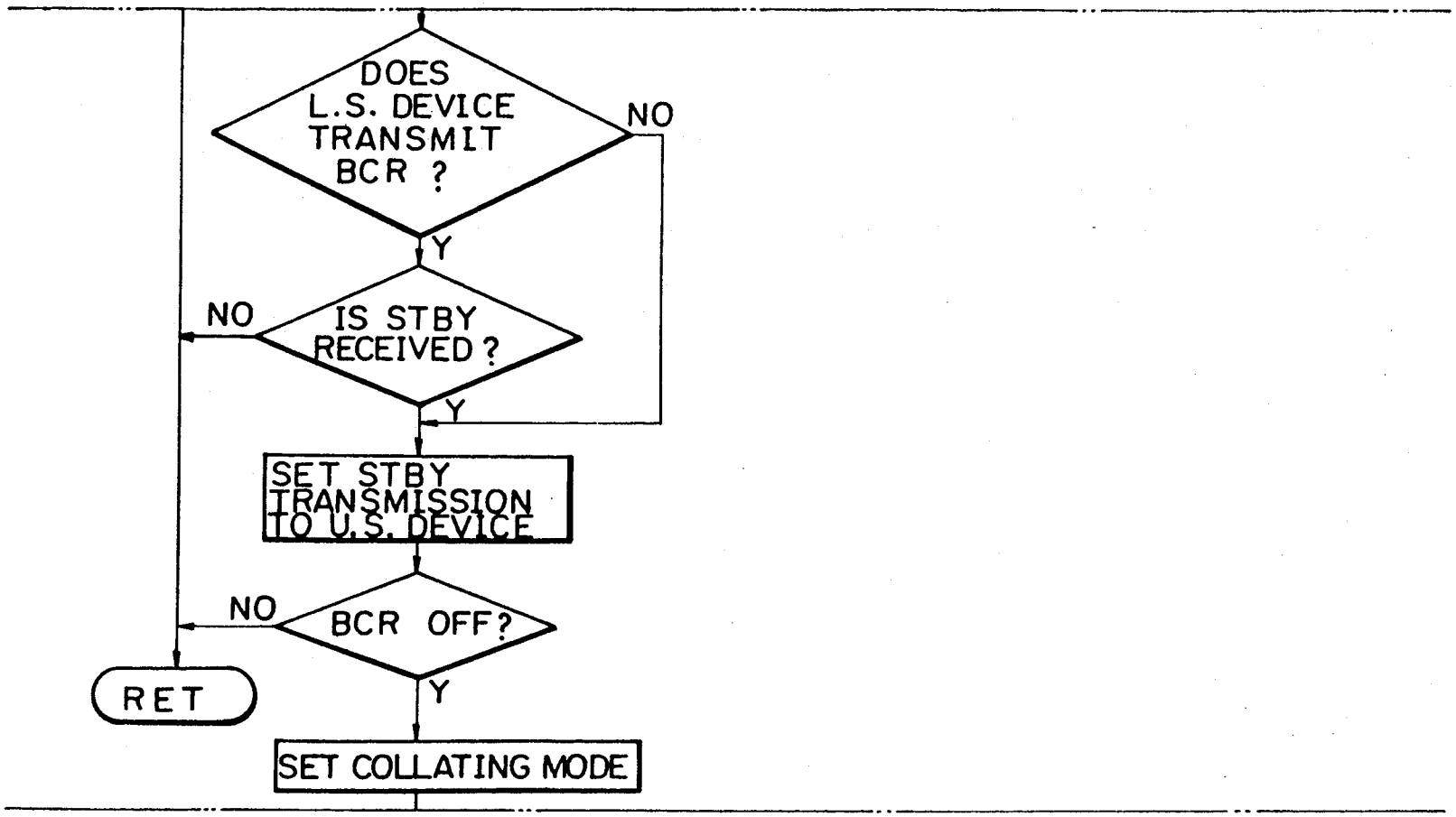
Figures 1D, 7:
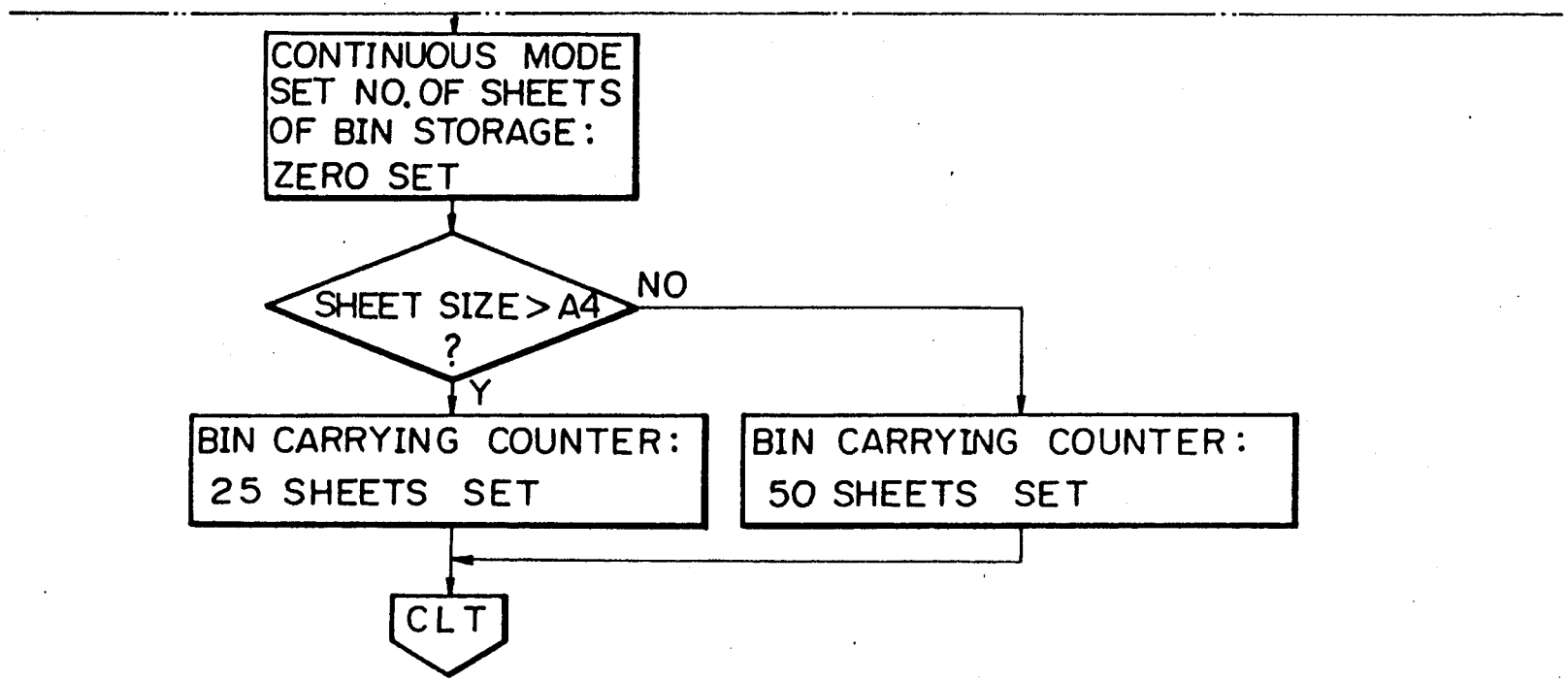
Figures 2, 7:
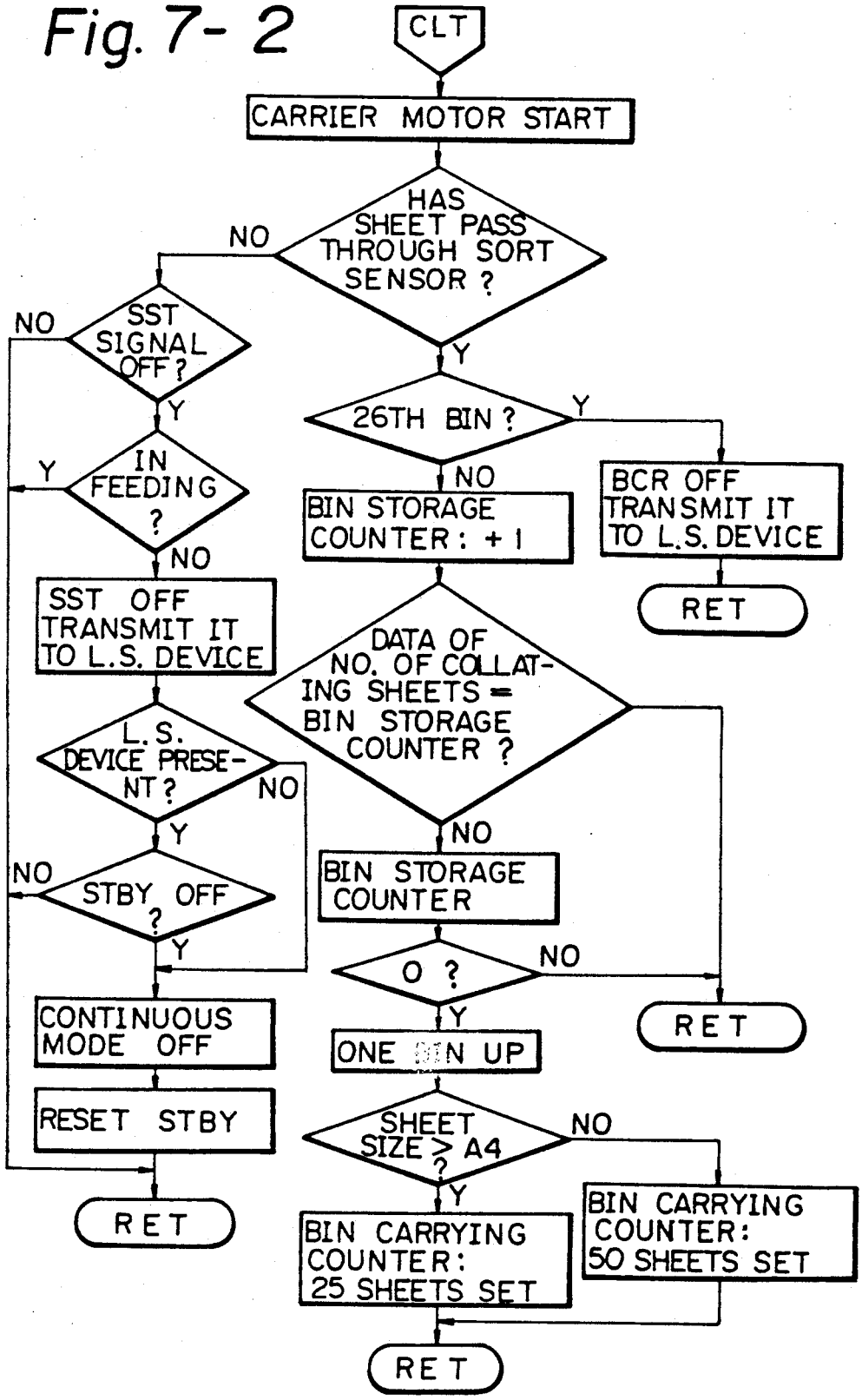

Now reference is made to FIGS. 7-1 and 7-2 for explaining the operation in the collating mode. In the following explanation it is assumed that 50 copies are made on A3-sized sheets from each of 2 originals.

When the copy key of the copying apparatus is actuated, data on copy number (50 copies) and collating mode, and then BCR/SST signals are transmitted from the copying apparatus to the sorter 19. In response to the BCR signal, the sorter 19 sends data on the copy number (50 copies) and collating mode, and then BCR/SST signals, to the sorter 20, whereby the bins in the sorters 19, 20 are moved to the 1st bin position which is the home position in the collating mode.

Upon completion of the bin movement in the sorters 19, 20, the sorter 19 sends a STBY signal to the copying apparatus, thus advising that the sorters 19, 20 are ready for collating mode. In response the copying apparatus starts copying operation on A3-sized sheets and turns off the BCR signal. The sheet size is in advance transmitted to the sorter 19 from the copying apparatus.

(When the BCR signal is turned off, the sorter 19 determines the number of sheets that can be loaded in a bin according to the sheet size. Said number is 50 sheets for A4 and smaller sizes, and 25 sheets for larger sizes. The content of a sheet number counter is stepwise decreased for each A3 sized sheet stored in the bin. When 25 A3-sized sheets are thus stored in the bin, said counter is brought to zero to elevate the bins by a step, and the content of said counter is again set according to the sheet size. The remaining 25 sheets are therefore stored in a second bin. When 50 sheets in total are stored in this manner in the 1st and 2nd bins of the sorter 19, the number of sheets stored in the bins (50 copies) becomes equal to the preset copy number for collating mode, so that the bins are no longer elevated through the counter indicates zero.

After preparation of 50 copies from the first original, the copying apparatus sets the next original and sends a collating bin shift signal BSFT to the sorter 19. In response the sorter 19 shifts the bins upwards by a step after the copies of the first original are completely stored, then sets the sheet number counter according to the sheet size, and resets stored sheet data to zero. Then an operation as explained before is repeated. In this manner 50 sheets obtained from the first original are stored, 25 sheets each, into the 1st and 2nd bins of the sorter 19, and 50 sheets obtained from the second original are stored, 25 sheets each, into the 3rd and 4th bins.

Although the foregoing embodiment has been limited to a combination of a copying apparatus and sorters, the present invention is by no means limited to such combinations of a printer for recording computer-generated data and sorters.

Also it is to be understood that the present invention is not limited to the foregoing embodiment but is subject to various modifications within the scope and spirit of the appended claims.

What is claimed is:

1. A sheet sorter comprising:

a first sheet storage unit for storing sheets fed thereto;

a second sheet storage unit for storing sheets transferred thereto through said first sheet storage unit, each of said first and second sheet storage units comprising plural storage bin means;

first moving means for moving said storage bin means to store the sheets in said first sheet storage unit;

second moving means for moving said storage bin means to store the sheets in said second sheet storage unit;

transfer means for transferring the sheets from said first sheet storage unit to said second sheet storage unit, said transfer means being movable relative to said second sheet storage unit; and control means for controlling said first moving means and, said second moving means so that a series of sheets related to a first job is stored in said first sheet storage unit and said second sheet storage unit, in that order, and a series of sheets related to a second job is stored in these storage units in the opposite order.

2. A sheet sorter according to claim 1, wherein said first and second moving means are adapted to move said plural storage bin means means associated with said first and second sheet storage unit in one united body.

3. A sheet sorter according to claim 1, wherein said control means is adapted to control said second moving means in such a manner as to prohibit the movement of said plural storage bin means associated with said second sheet storage unit after the last of a series of sheets relating to the first job is stored in said storage bin means in said second sheet storage unit and to initiate storage for a series of sheets related to the second job from said storage bin means in which the last of a series of sheets related to the first job is stored.

4. A sheet sorter comprising:

a first sheet storage unit for storing sheets fed thereto;

a second sheet storage unit for storing sheets fed from said first sheet storage unit, each of said first and second sheet storage units comprising plural storage bin means;

first moving means for moving said storage bin means associated with said first sheet storage unit to store the sheets in said first sheet storage unit;

second moving means for moving said storage bin means associated with said second sheet storage unit to store the sheets in said second sheet storage unit;

transfer means for transferring the sheets from said first sheet storage unit to said second sheet storage unit, said transfer means being movable relative to said second sheet storage unit; and control means for controlling said transfer means so that movement of said transfer means is prevented until storage of sheets in said second sheet storage unit is completed.

5. A sheet sorter according to claim 4, wherein each of said first and second moving means is adapted to move said plural storage bin means associated with said first and second sheet storage unit in one united body.

6. A sheet sorter according to claim 5, wherein said first sheet storage unit comprises conveyor means for transporting sheets which are in excess of the sorting capacity of said first sheet storage unit to said second sheet storage unit.

7. A sheet sorter comprising:

a first sheet storage unit including plural storage bin means, for storing sheets fed thereto;

a second sheet storage unit including plural storage bin means, connected in cascade to said first sheet storage unit, for storing sheets fed from said first sheet storage unit;

first moving means for moving said storage bin means of said first sheet storage unit as one united body, to store sheets in said first sheet storage unit;

second moving means for moving said storage bin means of said second sheet storage unit as one united body, to store sheets in said second sheet storage unit; and control means for controlling said first moving means so that sheet in excess of the capacity of said first sheet storage unit are transferred to said second sheet storage unit and the movement of said storage bin means of said first sheet storage unit is inhibited until the sheets in excess are stored in said second sheet storage unit, wherein said first sheet storage unit comprises conveyor means for transporting the sheets in excess to said second sheet storage unit, and said first moving means moves said conveyor means in one united body with said plural storage bin means of said first sheet storage unit.

8. A sheet sorter comprising:

a first sheet storage unit for storing sheets fed thereto;

a second sheet storage unit for storing sheets transferred thereto through said first sheet storage unit, each of said first and second sheet storage units comprising plural storage bin means;

first moving means for moving said storage bin means so as to store the sheets in said first sheet storage unit;

second moving means for moving said storage bin means to store the sheets in said second sheet storage unit;

transfer means for transferring the sheets from said first sheet storage unit to said second sheet storage unit, said transfer means being movable relative to said second sheet storage unit by said first moving means; and control means for controlling said first moving means and said second moving means, so that in the event that a series of sheets related to one job exceeds a processing capacity of said first sheet storage unit, movement of said transfer means is prevented in response to storage of the sheets corresponding to said processing capacity of said first sheet storage unit, and also movement of said storage bin means is prevented in response to storage of the last sheet to be stored into said storage bin means of said second sheet storage unit.

9. A sheet sorter according to claim 8, wherein said first and second moving means are adapted to move said plural, storage bin means associated with said first and second sheet storage unit in one united body.

10. A sheet sorter according to claim 8, wherein said first and second moving means are adapted to reverse a storage sequence of sheets between a case of the storage of sheets relating to a job and a case of the storage of sheets relating to a next job.

11. A sheet sorter comprising:

a first sheet storage unit for storing sheets fed thereto;

a second sheet storage unit for storing sheets transferred thereto through said first sheet storage unit, each of said first and second sheet storage units comprising plural storage bin means;

first moving means for moving said storage bin means to store the sheets in said first sheet storage unit;

second moving means for moving said storage bin means to store the sheet in said second sheet storage unit;

transfer means for transferring the sheets from said first sheet storage unit to said second sheet storage unit, said transfer means being movable relative to said second sheet storage unit; and control means for generating a signal for temporarily preventing feeding of sheets in the event a series of sheets is stored in said second sheet storage unit and said first sheet storage unit, in that order, said signal being generated before said storage bin means of said first sheet storage unit becomes available for sheet storage after completion of sheet storage to said second sheet storage unit.

12. A sheet sorter according to claim 11, wherein a series of sheets related to a first job is stored in said first sheet storage unit and said second sheet storage unit in the order named, and a series of sheets related to a second job is stored in these storage units in the opposite order.

13. A sheet sorter according to claim 11, wherein said transfer means is movable together with said storage bin means by means of said first moving means.

14. A sheet sorter according to claim 13, wherein said control means generates said signal so as to prevent a successive sheet from being transferred to said second sheet storage unit by said transfer means after transfer of the last of a series of sheets to be stored in said second sheet storage means.

15. A sheet sorter comprising:

a first sheet storage unit for storing sheets fed thereto;

a second sheet storage unit for storing sheets transferred thereto through said first sheet storage unit, each of said first and second sheet storage units comprising plural storage bin means;

first moving means for moving said storage bin means so as to store the sheets in said first sheet storage unit;

second moving means for moving said storage bin means to store the sheets in said second sheet storage unit;

transfer means for transferring the sheets from said first sheet storage unit to said second sheet storage unit, said transfer means being movable relative to said second sheet storage unit by said first moving means; and control means for controlling said first moving means and said second moving means, so that in the event that a series of sheets related to one job exceeds a processing capacity of said first sheet storage unit, movement of said transfer means is prevented in response to storage of the sheets corresponding to said processing capacity of said first sheet storage unit, and also movement of said storage bin means is prevented in response to storage of the last sheet to be stored into said storage bin means of said second sheet storage unit, said job being an operation for preparing a desired number of copies from a single original.

16. A sheet sorter according to claim 15, wherein said control means is arranged to inhibit the movement of said storage bin means associated with said first or second sheet storage unit when the number of sorted sheets coincides with the number of copies to be prepared from a single original.

* * * * *

UNITED STATES PATENT AND TRADEMARK OFFICE

CERTIFICATE OF CORRECTION

PATENT NO. : 5,013,027

DATED : May 7, 1991

INVENTOR(S) : Hideaki Furukawa

It is certified that error appears in the above-identified patent and that said Letters Patent is hereby corrected as shown below:

COLUMN 5

Line 41, "(When" should read --When--.

IN THE CLAIMS

COLUMN 6

Line 27, "and," should read --and--.

COLUMN 7

Line 67, "plural," should read --plural--.

COLUMN 8

Line 15, "sheet" (first occurrence) should read --sheets--.

Signed and Sealed this

Twenty-fourth Day of November, 1992

*Attest:*

DOUGLAS B. COMER

*Attesting Officer*

*Acting Commissioner of Patents and Trademarks*